United States Patent [19]

Stonehouse

[11] 4,082,594

[45] Apr. 4, 1978

[54] METHOD FOR MAKING A WRAPPING MATERIAL

[75] Inventor: Ernest Stonehouse, Midsomer Norton, England

[73] Assignee: Mardon Flexible Packaging Limited, England

[21] Appl. No.: 762,661

[22] Filed: Jan. 26, 1977

[30] Foreign Application Priority Data

Feb. 4, 1976 United Kingdom ..... 4327/76

[51] Int. Cl.[2] ..... B32B 29/06; B05D 3/12; B32B 3/24; B32B 15/20

[52] U.S. Cl. ..... 156/253; 93/36 PC; 156/268; 156/270; 156/302; 229/3.5 MF; 229/87 G; 229/DIG. 14; 426/415; 427/250; 427/251; 427/270; 427/276; 427/277; 427/278; 427/288; 428/138

[58] Field of Search ..... 427/250, 251, 276, 277, 427/278, 288, 289, 257; 156/253, 268, 302, 324, 270; 428/137, 138; 426/118, 126, 415; 162/205, 206; 229/87 G, 3.5 MF, DIG. 14; 93/36 PC; 29/458

[56] References Cited

U.S. PATENT DOCUMENTS

| | | | |
|---|---|---|---|
| 1,148,783 | 8/1915 | Knappstein | 427/278 X |
| 1,368,080 | 2/1921 | Van Sluys | 427/271 |
| 2,003,494 | 6/1935 | Reynolds | 93/36 PC UX |
| 2,382,432 | 8/1945 | McManus et al. | 427/250 |
| 3,012,894 | 12/1961 | Nagel | 229/3.5 MF UX |
| 3,097,124 | 7/1963 | Denenberg | 156/253 X |
| 3,398,826 | 8/1968 | Clancy | 229/3.5 MF UX |
| 3,602,422 | 8/1971 | Dewhurst | 229/3.5 |
| 3,690,923 | 9/1972 | Vessie | 428/319 X |
| 3,730,076 | 5/1973 | Levin | 229/3.5 MF X |

*Primary Examiner*—William A. Powell
*Assistant Examiner*—Thomas Bokan
*Attorney, Agent, or Firm*—Larson, Taylor and Hinds

[57] ABSTRACT

A method wherein a machine-foldable wrapper for chewing gum has a paper substrate metallized to give the appearance of continuous foil, the foil being made discontinuous to allow the paper to reach and maintain a moisture content which is in equilibrium with the ambient air. This prevents the wrapper from curling at the edges while in storage.

7 Claims, No Drawings

METHOD FOR MAKING A WRAPPING MATERIAL

This invention relates to a method of making a wrapping material having a substrate of paper, e.g. paper tissue.

The invention was originally conceived to produce an inner wrapping material for the packaging of so-called "sticks" (strips) of chewing gum but is not so limited in its application.

A known inner packaging material for chewing gum is an aluminum foil/wax/paper laminate. The foil provides the required appearance but it is expensive. In one form of high-speed wrapping machine for "sticks" of chewing gum, each piece of packaging laminate is required to drop down between a fast-travelling "stick" and a device for subsequently folding the laminate about the "stick". It is important that the laminate is flat and not curled if it is to be satisfactorily picked up by the "stick" and then folded correctly about it. With the known laminate referred to above, curling may take place due to too little or too much moisture content in the paper layer, with respect to the ambient air. The present invention avoids this curling and also uses less aluminium than the known laminate.

According to one aspect of the invention, a method of making a wrapping material comprises the steps of (a) applying metal in discrete form to a surface of a dry paper substrate to provide it with a layer which has visually the appearance of continuous foil, (b) and treating the resulting product to ensure that the metal layer is sufficiently discontinuous to allow the substrate to reach and maintain a moisture content which is in equilibrium with the ambient air whilst still preserving the visual appearance of continuous foil.

The invention will now be described with reference to the following Examples.

EXAMPLE 1

A paper tissue is chosen which has weak tensile strength and is inelastic. These characteristics assist dead folding in the finished wrapper. Such tissue may originate from a deciduous wood which has short fibres and in this Example is bleached sulphite tissue of substance 17–30g/m$^2$.

The paper tissue which is to be the substrate of the wrapping material is coated with a lacquer to provide a smoother surface, in this Example the lacquer being a nitrocellulose lacquer which is roller coated on to the tissue. The coated tissue is dried by heated air and is then passed through a vapour depostion chamber where aluminium in vapour form is deposited on the lacquer coat. The smooth surface of the lacquer coat enhances the appearance of the deposited vapourised metallic foil which although applied in discrete form has the appearance of a continuous layer of foil as viewed by the eye of an observer.

The next step is to ensure that the foil layer and lacquer coat are sufficiently discontinuous to be permeable to water vapour. Accordingly, the tissue/metallised lacquer product is pulled around an edge of a creasing rule, with the paper tissue adjacent the rule, so as to provide minute cracks in the foil layer and lacquer coat.

Because of the drying effect in the vapour deposition chamber the product is then passed through a reconditioning steam chamber or equivalent apparatus to restore substantially the moisture content of the tissue as it was before the application of the lacquer. This helps the product to fold well during subsequent wrapping.

Preferably, a protective layer of transparent varnish or of wax is applied to the foil layer so as to retain the metallic particles on the lacquer. In which case the product must then be again pulled around the creasing rule to produce minute cracks in the protective layer and thus ensure its permeability to water vapour.

The ensured permeability of the protective layer and metallised lacquer coat permits the whole of the tissue substrate to reach and/or maintain a moisture content which is in equilibrium with the ambient air, particularly at the wrapping machine where the finished product, now a wrapping material, is cut into pieces for wrapping "sticks" of chewing gum or other articles. Because of such equilibrium the wrapper material does not curl due to a lack of equilibrium. As a result the wrapper material remains flat to assist correct entry into a wrapping machine and subsequent wrapping about the "sticks". The inelastic nature of the tissue assists the permeable foil to provide the required dead-fold characteristic.

If desired, the aluminium foil in the vapour depostion chamber may be tinted to provide a foil layer with a golden colour.

EXAMPLE 2

The Example follows that of Example 1 except that the paper tissue is replaced by a glazed imitation parchment paper of substance 25g/m$^2$–50g/m$^2$ which also is weak and inelastic.

EXAMPLE 3

This Example follows that of Example 1 except that the dried lacquer coat is made sufficiently discontinuous to be permeable to water vapour before the vapour deposition step. After the latter step the foil layer is likewise made permeable.

EXAMPLE 4

A paper is chosen which has weak tensile strength and is inelastic. An example of such a paper is so-called bible paper. The paper which is to be the substrate of the wrapping material is machine glazed to provide a smoother surface. Preferably, the glazed surface is coated with a lacquer to provide a smooth receptive surface. Instead of glazing, the substrate may be calendered.

After drying by heated air, the glazed paper is passed through a vapour deposition chamber where aluminium in vapour form is deposited on the glazed surface or lacquer coat. Although the deposited foil layer is applied in discrete form it has visually the appearance of continuous foil.

The resulting product is treated as described with reference to Example 1 to produce minute cracks in the foil layer and lacquer coat, if any. The product is then passed through a steam chamber or humidifier to restore substantially the moisture content of the paper as it was before metallising.

Preferably, a protective layer of transparent varnish or wax is applied to the foil layer. In which case the product is again treated as described previously to produce minute cracks in the protective layer and thus ensure its permeability to water vapour.

EXAMPLE 5

A paper for the substrate is as described in Example 1, 2 or 4. The paper substrate is bonded by an adhesive, e.g. a sodium silicate adhesive, to a sheet of aluminium foil of 0.006 mm thickness. The thin aluminium laminate which may or may not already have a pinhole structure is treated to ensure that it is sufficiently discontinuous to allow the paper to reach and maintain a moisture content in equilibrium with the ambient air whilst still preserving the visual appearance of continuous foil. Such treatment is carried out by pulling the paper/foil laminate around the edge of a creasing rule so as to provide minute cracks in the foil. If the original moisture content of the paper has not been restored by the adhesive, the laminate is passed through a humidifier. The resulting paper/foil laminate will not curl and will fold well during subsequent machine handling and wrapping operations.

With respect to any of Examples 1–4, instead of vapour deposition the metallising step may be carried out by any one of the three following steps.

1. The lacquered or glazed paper substrate is coated with a mixture of aluminium powder and either polyvinyl acetate, polyvinylchloride, or polyvinlidenechloride. The plastics material used must be non-plasticised to provide permeability and to assist folding.

2. The lacquered or glazed paper substrate is coated with a mixture of aluminium powder and a transparent wax.

3. Aluminium powder dispersed in ink, a so-called "silver" ink, is printed on the lacquered or glazed paper substrate.

With these three steps, the reconditioning or moistening step may normally be omitted.

Also, with respect to each Example, instead of pulling the product around an edge of a creasing rule to ensure the required permeability; the product may be embossed in such a fashion as to produce minute openings, e.g. by pulling it through a pair of contra-rotating knurled rollers, or alternatively the product may be perforated by needles.

What we claim is:

1. A method of making a flexible wrapping material comprising the steps of (a) applying metal in discrete form to a surface of a dry flexible paper substrate to form a layer having visually the appearance of continuous foil, (b) and treating the resulting product to form a discontinuous metal layer to allow the substrate to reach and maintain a moisture content which is in equilibrium with the ambient air and simultaneously preserving the visual appearance of continuous foil.

2. A method according to claim 1 and further including the step of moistening to approach such equilibrium.

3. A method according to claim 1, including the preliminary step of machine glazing the substrate prior to applying metal thereto.

4. A method according to claim 1, including the preliminary step of coating the substrate with a lacquer on the surface to receive the foil.

5. A method according to claim 4, wherein the lacquer coat is first dried and subsequently the metal is applied to the substrate by passing the substrate through a vapor deposition chamber where aluminium in vapor form is deposited on the lacquer coat.

6. A method according to claim 1, wherein following the steps of applying metal to the substrate and treating the resulting product to form a discontinuous metal layer, the foil is covered with a transparent layer of varnish or wax and treating the product to form a discontinuous said varnish or wax layer.

7. A method according to claim 1, wherein the product is treated to form a discontinuous layer by pulling the product around an edge to produce minute cracks in the layer of foil.

* * * * *